US008627626B2

(12) United States Patent
Boxall et al.

(10) Patent No.: US 8,627,626 B2
(45) Date of Patent: Jan. 14, 2014

(54) TRANSFERRING LOADS ACROSS JOINTS IN CONCRETE SLABS

(76) Inventors: Russell Boxall, Charlotte, NC (US); Nigel K Parkes, Atlanta, GA (US)

( * ) Notice: Subject to any disclaimer, the term of this patent is extended or adjusted under 35 U.S.C. 154(b) by 368 days.

(21) Appl. No.: 12/764,706

(22) Filed: Apr. 21, 2010

(65) Prior Publication Data

US 2011/0258958 A1 Oct. 27, 2011

(51) Int. Cl.
*E01C 11/14* (2006.01)

(52) U.S. Cl.
USPC ..... 52/396.02; 52/426; 52/585.1; 404/57

(58) Field of Classification Search
USPC ..... 52/396.02, 396.04, 396.1, 426, 585.1, 52/677; 404/56, 57, 60
See application file for complete search history.

(56) References Cited

U.S. PATENT DOCUMENTS

| | | | | | |
|---|---|---|---|---|---|
| 2,094,853 | A | * | 10/1937 | Shaw | 404/56 |
| 2,216,979 | A | * | 10/1940 | Michael | 52/704 |
| 2,262,090 | A | * | 11/1941 | Brickman et al. | 404/57 |
| 2,305,979 | A | * | 12/1942 | Mitchell | 404/59 |
| 3,559,541 | A | * | 2/1971 | Watstein | 404/60 |
| 4,100,954 | A | * | 7/1978 | Muller et al. | 411/23 |
| 4,449,844 | A | * | 5/1984 | Larsen | 404/60 |
| 4,733,513 | A | * | 3/1988 | Schrader et al. | 52/396.02 |
| 5,005,331 | A | * | 4/1991 | Shaw et al. | 52/396.02 |
| 5,040,350 | A | * | 8/1991 | Panther | 52/704 |
| 5,618,125 | A | * | 4/1997 | McPhee et al. | 403/12 |
| 5,674,028 | A | * | 10/1997 | Norin | 404/74 |
| 5,713,174 | A | * | 2/1998 | Kramer | 52/396.02 |
| 5,934,821 | A | * | 8/1999 | Shaw et al. | 404/62 |
| 6,145,262 | A | * | 11/2000 | Schrader et al. | 52/396.02 |
| 6,354,760 | B1 | | 3/2002 | Boxall et al. | |
| 6,471,441 | B1 | | 10/2002 | Muller | |
| 6,926,463 | B2 | * | 8/2005 | Shaw et al. | 404/60 |
| 7,314,333 | B2 | * | 1/2008 | Shaw et al. | 404/60 |
| 7,338,230 | B2 | * | 3/2008 | Shaw et al. | 404/58 |
| 7,441,985 | B2 | * | 10/2008 | Kelly et al. | 404/56 |
| 7,481,031 | B2 | * | 1/2009 | Boxall et al. | 52/396.02 |
| 7,604,432 | B2 | * | 10/2009 | Shaw et al. | 404/60 |
| 7,637,689 | B2 | | 12/2009 | Boxall et al. | |

(Continued)

FOREIGN PATENT DOCUMENTS

| | | |
|---|---|---|
| EP | 1299492 A1 | 9/2003 |
| EP | 1477620 | 11/2004 |

(Continued)

OTHER PUBLICATIONS

International Search Report, International Application No. PCT/US2011/033023, Jul. 8, 2011, 10 pages.

*Primary Examiner* — Adriana Figueroa
(74) *Attorney, Agent, or Firm* — Banner & Witcoff, Ltd.

(57) ABSTRACT

Novel dowel structures and related methods are provided. In one embodiment, a unitary dowel structure is formed from a plurality of laminates. In certain embodiments, a first dowel laminate may be placed substantially above or below one or more other dowel laminates. At least one laminate may include a first material that is substantially devoid in another laminate. Upon being in communication, the laminates may form a unitary dowel structure having a first end and a second end that are configured to flex in a vertical direction without breaking to transfer stress loads from a concrete slab in communication with the first end of the unitary dowel structure and a concrete slab in communication with the second end of the unitary dowel structure.

11 Claims, 7 Drawing Sheets

(56) References Cited

U.S. PATENT DOCUMENTS

| | | | | |
|---|---|---|---|---|
| 7,736,088 | B2 | 6/2010 | Boxall et al. | |
| 2007/0231068 | A1* | 10/2007 | Francies et al. | 404/56 |
| 2008/0008849 | A1 | 1/2008 | Mazurek et al. | |
| 2008/0011416 | A1 | 1/2008 | De Meter | |
| 2008/0267704 | A1* | 10/2008 | Shaw et al. | 404/58 |
| 2010/0003080 | A1* | 1/2010 | Shaw et al. | 404/88 |

FOREIGN PATENT DOCUMENTS

| | | |
|---|---|---|
| GB | 2035412 | 6/1980 |
| WO | 9925934 | 5/1999 |
| WO | 2010147622 A1 | 12/2010 |

* cited by examiner

TRANSFERRING LOADS ACROSS JOINTS IN CONCRETE SLABS

BACKGROUND

Concrete is often cast in place, for example, by pouring wet concrete over a surface and allowing it to cure to form slabs. For logistical and technical reasons, concrete slabs for example, utilized for flooring, paving, and transportation are often made up of a series of individual blocks. Referring to FIG. 1, a concrete product, such as concrete floor 100 is typically made up of a series of individual blocks or slabs 102-1 through 102-6 (collectively 102). The same is true for sidewalks, driveways, roads, and the like. Blocks 102 provide several advantages, including relief of internal stress due to drying shrinkage and thermal movement.

Adjacent blocks 102 meet each other at joints, such as joints 104-1 through 104-7 (collectively 104). There may be different types of joints, for example, the term "construction joint" is often used to define a termination point that separates an initial pour from a second pour, such as a first day's pour from a second day's pour. Other joints may be created within large slabs or blocks. For example, the term "contraction joints" often is used to refer to joints intentionally created that allow for at least the partial relief of internal stresses in the concrete slab that build up due to thermal expansion or drying shrinkage. Regardless, joints 104 are typically spaced so that each block 102 has enough strength to overcome internal stresses that would otherwise cause random stress relief cracks. In practice, blocks 102 should be allowed to move individually but should also be able to transfer loads from one block to another block.

Transferring loads between blocks 102 is usually accomplished through dowels, which historically have been smooth steel rods embedded in the two blocks 102 defining the joint 104. For instance, FIG. 2 shows a side view of dowel 200 between slabs 102-4 and 102-5 and FIG. 3 is a cross-sectional plan view along a section a portion of which is depicted by sectional arrow 3-3 in FIG. 2. FIG. 3 shows several dowels 200 spanning joints 104 between slabs 102. Such circular or square dowels are capable of transferring loads between adjacent slabs 102, but have several shortcomings. One is that dowels 200 are typically used to prevent relative vertical movement between adjacent slabs. While this property is beneficial after curing, it is detrimental during the curing process. Freshly placed concrete, which includes cement and water, shrinks considerably as it hardens due to the chemical reactions between the cement and the water, i.e., hydration.

Other internal stresses in concrete slabs result from the differences in temperature, humidity and available water between various portions, such as the top and the bottom, of a slab during curing. For example, FIG. 4 shows a side view of slab 402 (having a top 404, bottom 406 and edge 408) and slab 410 (having top 412, bottom 414 and edge 416), which are undergoing a curing process. Due to differences in temperature, humidity and/or available water between the tops 404, 412 and the bottoms 406, 414 of the slabs 402 and 410, the edges 408, 416 may move vertically along axis 418. For example, slabs 402 and 410 are shown moving vertically (or "curling") away from surface 420. While the edges 408, 416 of slabs 402, 410 are shown moving away from surface 420 to form a concave top surface, the conditions may result in the edges 408, 416 of one or more of the slabs 402, 410 moving downwards towards surface 420 to form a slightly convex upper surface ("warping"). Regardless of the direction of the movement along axis 418, the interface between the two adjacent slabs 402, 410 is often altered.

As discussed above, conventional dowels are rigid structures, thus they do not accommodate the relative curling or warping movement at the periphery of a slab, nor compensate for the curling or warping movement of the periphery of the adjacent slab. For example, FIG. 5 shows a side view of slab 502 (having a top 504, bottom 506 and edge 508) and slab 510 (having a top 512 and a bottom 514). During curing, variations in temperature, humidity and/or available water between the tops 504, 512 and the bottoms 506, 514 of the slabs 502 and 510, may lead to curling and/or warping. As shown in FIG. 5, the edges 508, 516 may move vertically along axis 518. For example, slabs 502 and 510 are shown moving vertically upwards (curling) away from surface 520.

Dowel 522 is a rigid structure that extends across joint 524 and is embedded within slabs 502, 510. Being rigid, dowel 522 may undesirably restrict slabs 502, 510 from moving relative to each other along the vertical axis 518 of joint 524 during curing, thereby resulting in stresses that can accumulate and lead to failure of the concrete around the dowel or cracking in the slabs as shown by cracks 526, 528. Thus, the art would benefit from an improved dowel and methods of using an improved dowel that overcomes one or more of the shortcoming of prior art systems and methods.

SUMMARY OF THE INVENTION

The following presents a general summary of aspects of the invention in order to provide a basic understanding of the invention and various features of it. This summary is not intended to limit the scope of the invention in any way, but it simply provides a general overview and context for the more detailed description that follows.

Aspects of the invention relate to novel dowel structures. In one embodiment, the novel dowel structure may comprise a first dowel laminate configured to be placed against and in communication with a second dowel laminate. In one embodiment, the first dowel laminate is placed substantially above the second dowel laminate, yet in another embodiment, the first dowel laminate may be placed substantially below the second dowel laminate. Further embodiments may include additional laminates, such as substantially above and/or below the first and/or second dowel laminates. In one embodiment, at least one dowel laminate includes a first material that is substantially devoid in another laminate. In one embodiment, at least one laminate exhibits different structural properties than at least one other laminate.

Upon being in communication, the laminates form a unitary dowel structure having a first end and a second end that is configured to flex in a vertical direction without breaking In one embodiment, the flexing of the unitary dowel structure transfers stress loads from a concrete slab in communication with the first end of the unitary dowel structure and a concrete slab in communication with the second end of the unitary dowel structure. In one embodiment, the unitary dowel structure may be configured to flex at about a first position from the lateral plane in a vertical direction. In another embodiment, the unitary dowel structure may be configured to flex at about a first position from the lateral plane in a vertical direction upon being subjected to a first force and further configured to flex to about a second position upon being subjected to a second force.

Two or more dowel laminates may be held in communication by an unbondable adhesive. In further embodiments, mechanical structures, such as for example, rivets, bolts, screws, nails, staples, among others, may be used between at least two dowel laminates. The mechanical structure may comprise components formed around at least a portion of an outer surface of the unitary dowel structure. In another embodiment, the mechanical structure may comprise a structure that passes within a perimeter of an outer surface of at least of one dowel laminate.

In further embodiments, a portion of at least one dowel laminate may have a width, depth, or length that is different than the width, depth, or length of a portion of another dowel laminate. The dowel laminates may comprise a myriad of shapes, including for example, triangular, rectangular, cylindrical, and/or trapezoidal.

Further aspects of the invention relate to methods for making a unitary dowel structure. In one exemplary method, a first dowel laminate having a first end and a second end along a length of a lateral plane may be provided. At least a second dowel laminate may be joined to the first dowel laminate, wherein the second dowel laminate comprises a first end and a second end along a length of a lateral plane. In one embodiment, the joining of the first and the second dowel laminates comprises placing at least a portion of the lateral plane of the first laminate against the lateral plane of the second laminate. In one embodiment, the joining of two or more dowel laminates provides a unitary dowel structure configured to flex in a vertical direction without breaking to transfer stress loads from a concrete slab in communication with the first end of the unitary dowel structure and a concrete slab in communication with the second end of the unitary dowel structure.

BRIEF DESCRIPTION OF THE DRAWINGS

A more complete understanding of the present invention and certain advantages thereof may be acquired by referring to the following detailed description in consideration with the accompanying drawings, in which.

The reader is advised that the attached drawings are not necessarily drawn to scale.

DETAILED DESCRIPTION

In the following description of various exemplary structures, reference is made to the accompanying drawings, which form a part hereof, and in which are shown by way of illustration various illustrative dowel structures. The reader should understand that these specific examples are set forth merely to illustrate examples of the invention, and they should not be construed as limiting the invention. Additionally, it is to be understood that other specific arrangements of components, laminates, and structures may be utilized, and structural and functional modifications may be made without departing from the scope of the present invention.

Figure 1:
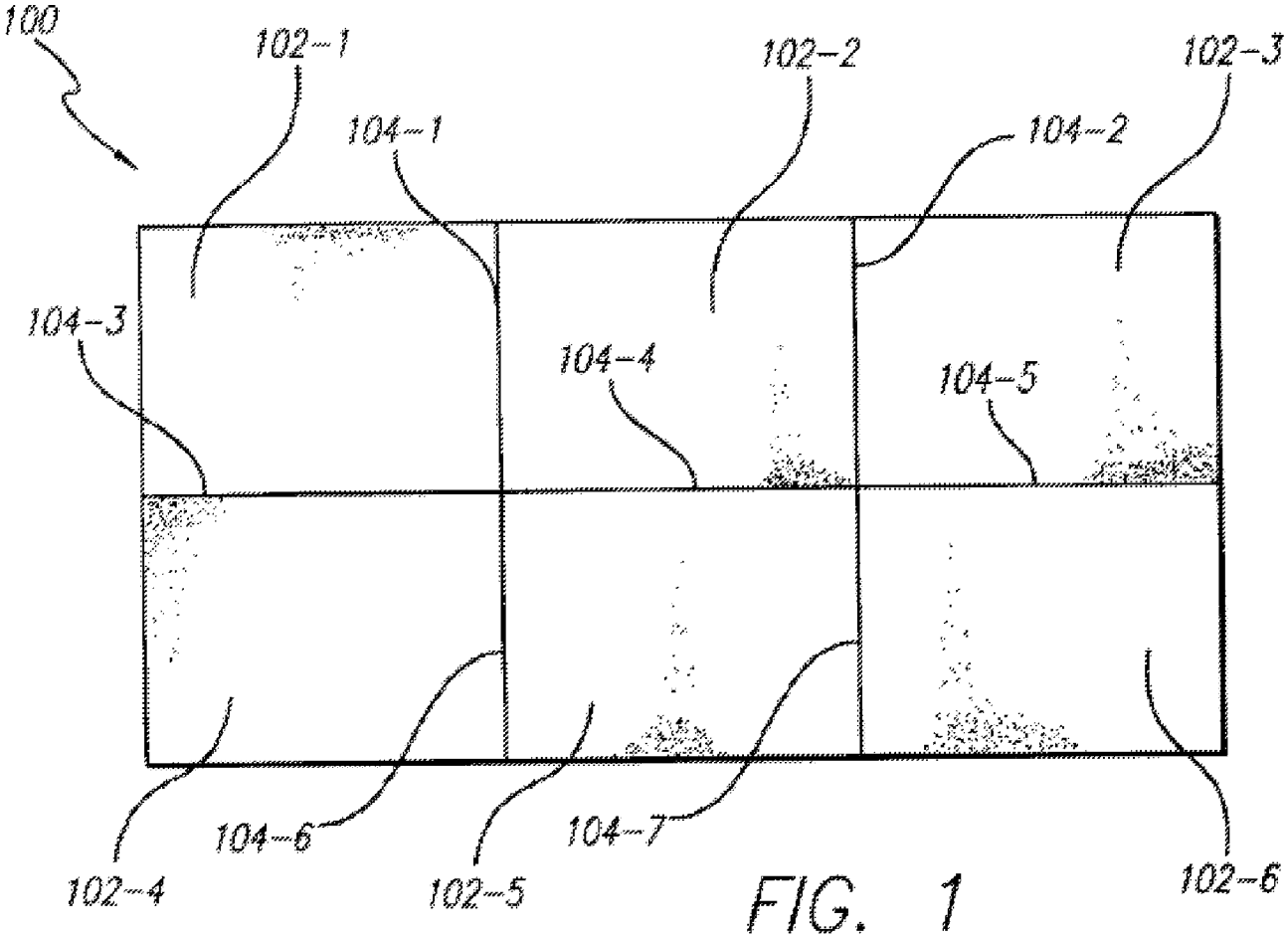
FIG. 1 shows an exemplary concrete floor comprising a series of individual blocks or slabs.
Figure 2:
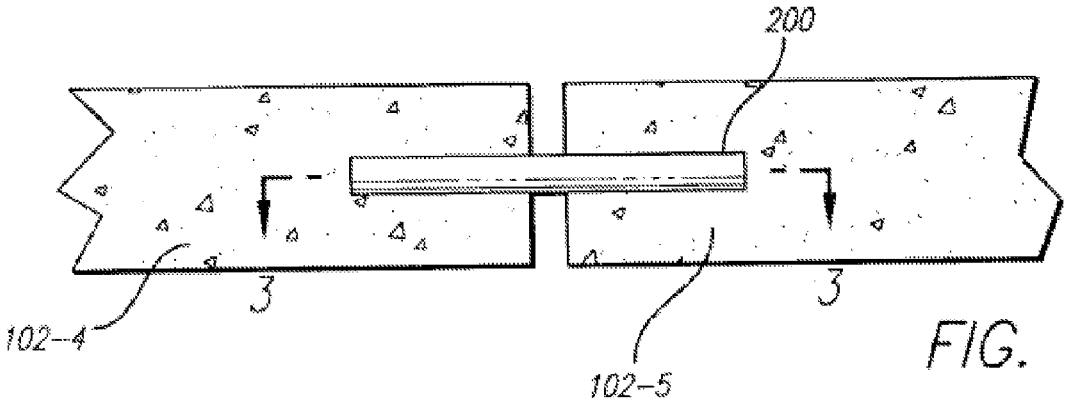
FIG. 2 shows a side view of a dowel placed between two slabs.
Figure 3:
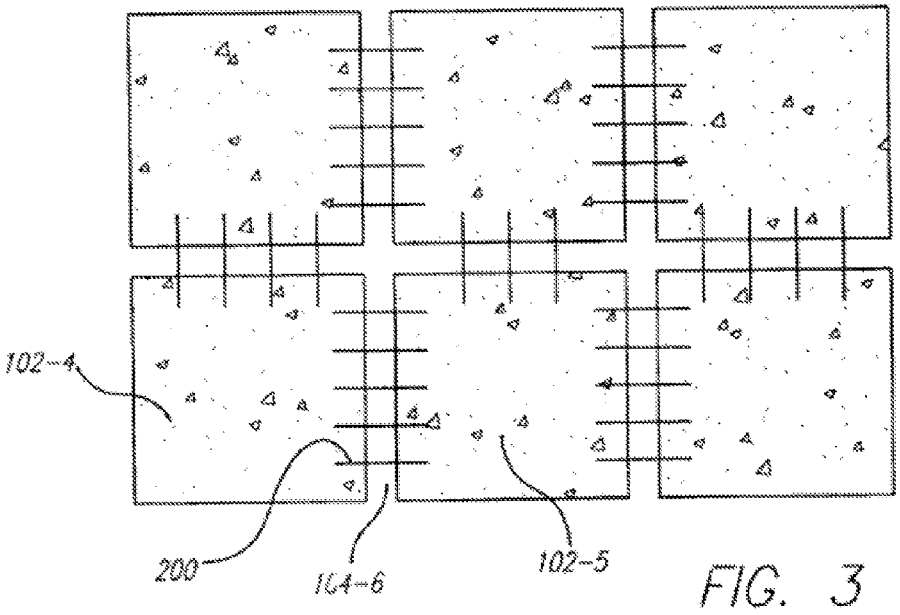
FIG. 3 is a cross-sectional plan view along a section a portion of which is depicted by sectional arrow 3-3 in FIG. 2.
Figure 4:
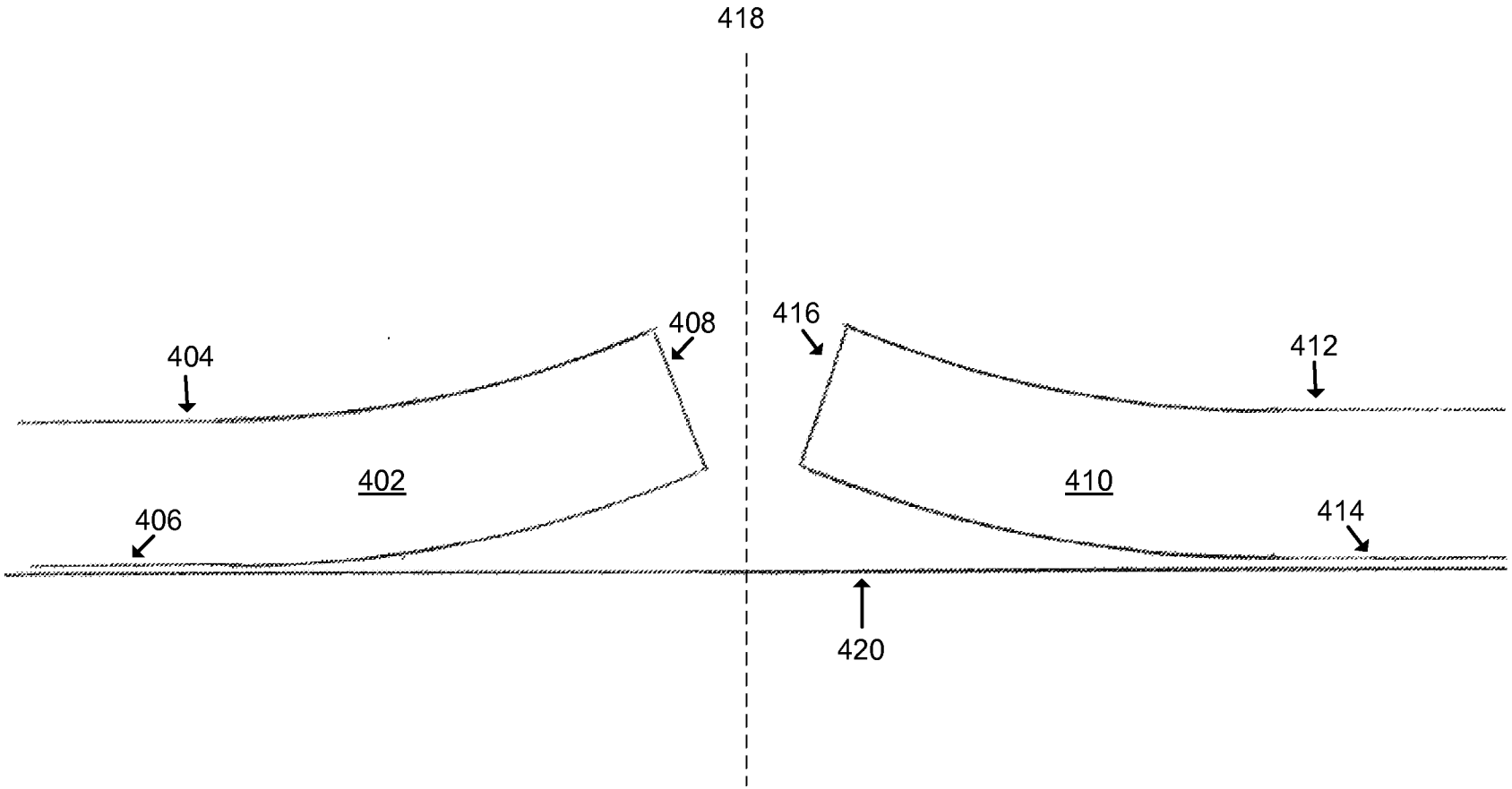
FIG. 4 shows a side view of two concrete slabs curling due to a curing process.
Figure 5:
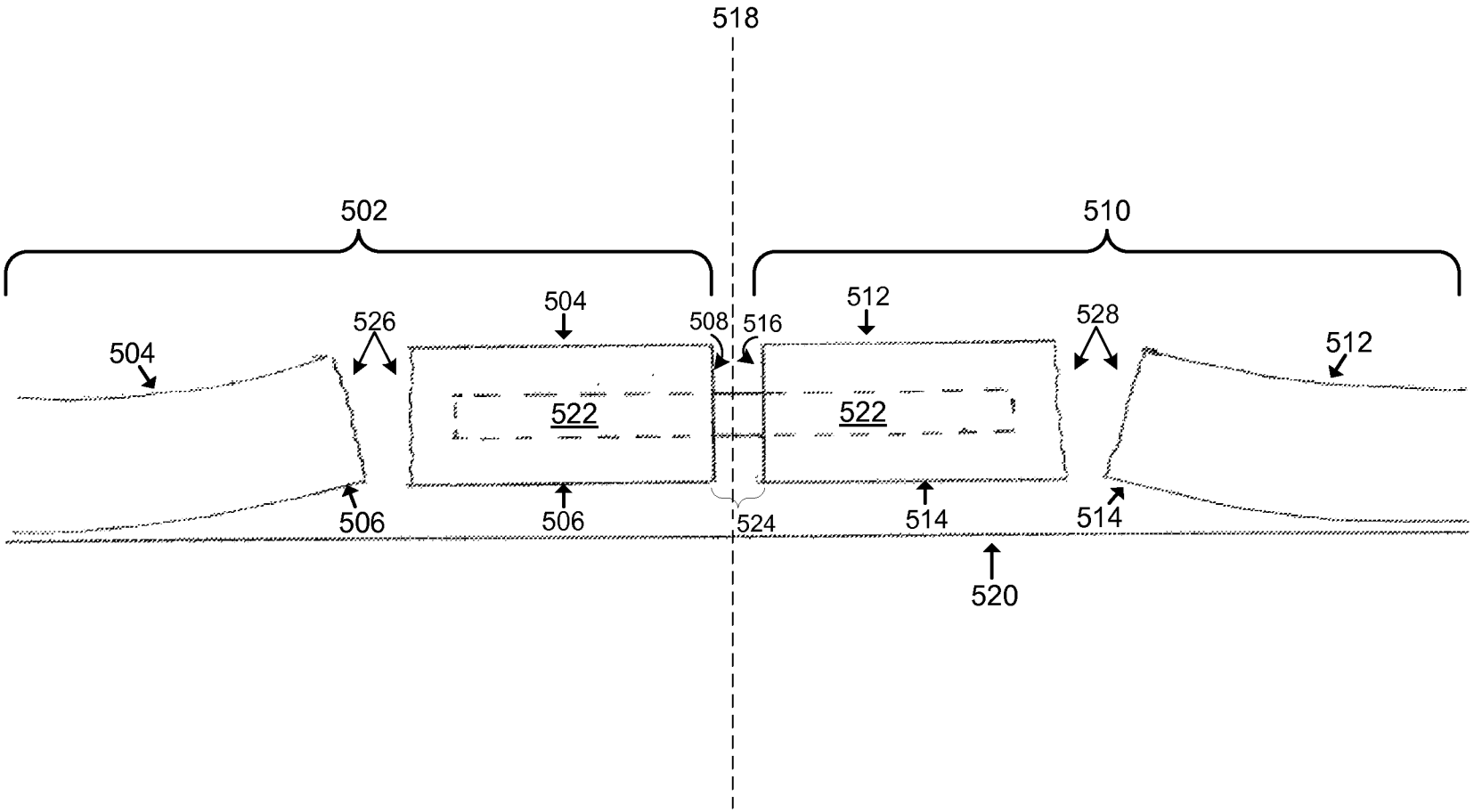
FIG. 5 shows a side view of two concrete slabs connected by a rigid dowel.
Figure 6A:
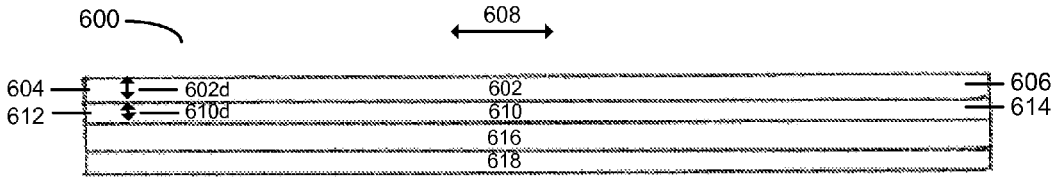
FIGS. 6*a*-6*c* show an exemplary dowel according to one embodiment of the invention.
Figure 6B:
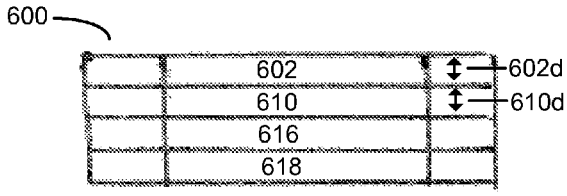
Figure 6C:
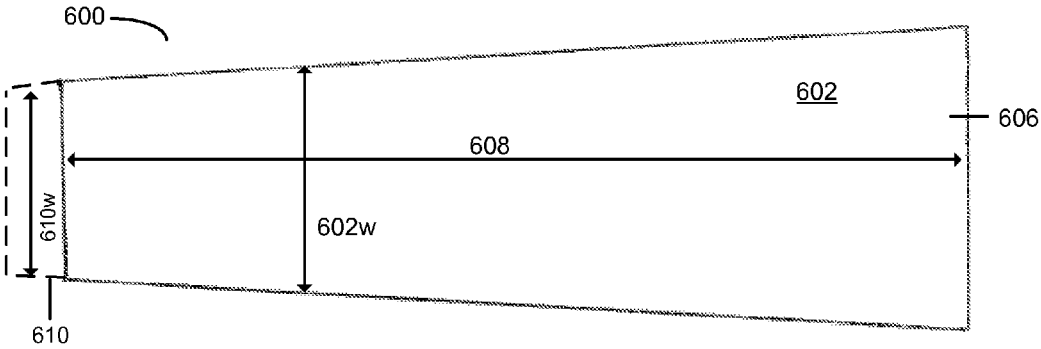

Aspects of the invention are directed towards plate doweling systems comprising more than one piece of material. In this regard, embodiments of the invention include laminate structures for transferring loads across a joint between two slabs. FIGS. 6*a*-6*c* show an exemplary dowel 600 in accordance with one embodiment of the invention. Looking first to FIG. 6*a*, which shows a side view of exemplary dowel 600, the dowel 600 comprises a first dowel laminate 602 having a first end 604 and a second end 606 along a lateral plane (represented in FIGS. 6*a* and 6*c* as double sided arrow 608). First laminate 602 is also shown to have a vertical depth (602*d*, best shown in FIGS. 6*a* and 6*b*) and a width (602*w*, best shown in FIG. 6*c*). As shown, the width 602*w* of the first laminate 602 may not be uniform as lateral plane 608 is travelled. In fact, as shown best in FIG. 6*c*, the exemplary dowel 600 narrows, such that the width 602*w* of the first laminate 602 at the first end 604 is more narrow than the width of the first laminate 602 at the second end 606. In the exemplary embodiment, the resulting shape comprises a trapezoidal structure. Other shapes, including a rectangular, cylindrical, and/or triangle-like shape is contemplated to be within the scope of this disclosure.

Dowel 600 further includes a second dowel laminate 610 that also has a first end 612 and a second end 614 along the lateral plane 608. (The depth and width of the second laminate is shown as 610*d* and 610*w*, respectively). While 610*w* is shown as being substantially identical to 602*w* across lateral plane 608, those skilled in the art will appreciate that this exemplary dowel 600 is merely one embodiment and that there is no requirement that 602*w* be substantially identical to 610*w*. In fact, the first laminate 602 and the second laminate 610 may be any shape and, in certain embodiments, vary in size along one or more dimensions, including the length, width and/or depth. For example, in one embodiment, a second dowel laminate 610 (discussed below) may have a length (i.e., along lateral plane 608) that exceeds the first dowel laminate 602. In one embodiment, the length of the unitary dowel 600 structure may be approximately 14 to 24 inches long. In another embodiment, the depth of the unitary dowel structure 600 may be approximately 0.5-2 inches. Furthermore, additional dowel laminates, such as the third dowel laminate 616, and/or fourth dowel laminate 618 may be used. The disclosure is not limited to a predetermined number of laminates within the dowel 600, rather two or more laminates may be used in accordance with various embodiments of the invention.

In certain embodiments, first dowel laminate 602 may include one or more materials that are substantially devoid in the second laminate. Further, as shown best in FIGS. 6*a* and 6*b*, a surface (such as the top and/or bottom) of one of the dowel laminates (i.e., 602, 610, 616, 618) along the lateral plane (arrow 608) is configured to be placed against the lateral plane of an adjacent laminate (i.e., 602, 610, 616, 618), such that the unitary dowel structure 600 is created. Unlike conventional rigid dowels, the unitary dowel structure 600 is configured to flex in a vertical direction without breaking to transfer stress loads from a concrete slab in communication with the first end of the unitary dowel structure and a concrete slab in communication with the second end of the unitary dowel structure.

Figure 7A:
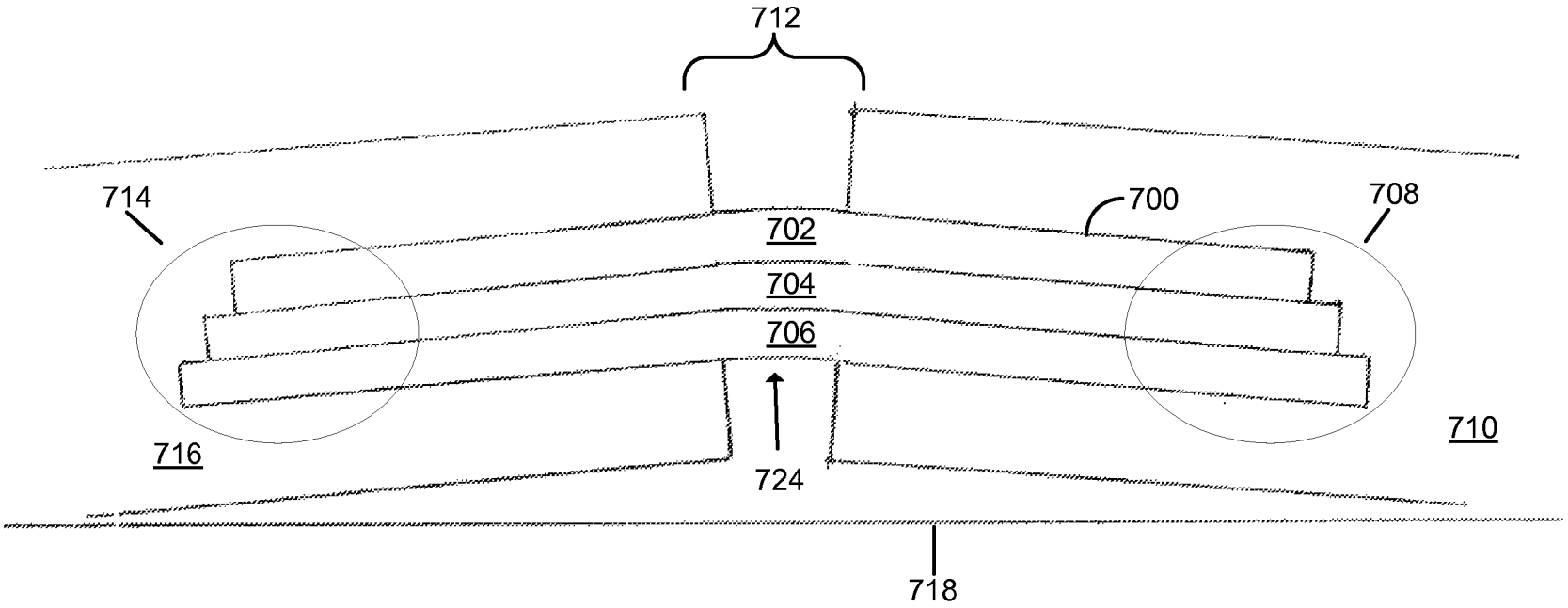
FIGS. 7*a* and 7*b* show a flexible unitary dowel structure according to one embodiment of the invention.
Figure 7B:
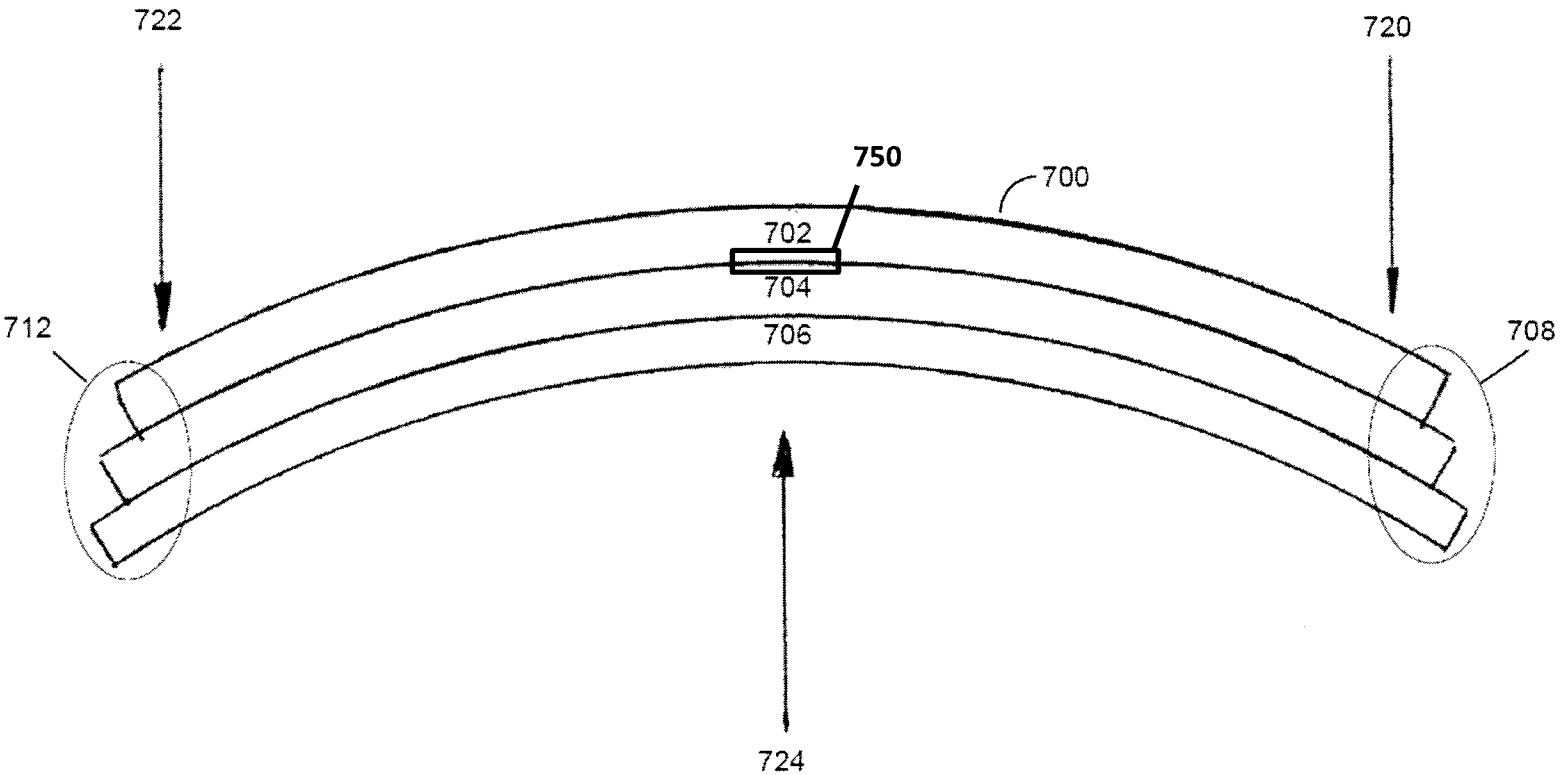

FIGS. 7*a* and 7*b* show a flexible unitary dowel structure 700 according to one embodiment of the invention. Specifically, FIG. 7*b* shows the unitary dowel structure 700 and forces applied upon it when under a load and FIG. 7*a* shows unitary dowel structure 700 imbedded within two slabs across a joint. As seen, unitary dowel structure 700 comprises three distinct dowel laminates (702-706), hereinafter referred to as the first, second and third dowel laminates, respectively. In one embodiment, at least one of the dowel laminates 702-706 includes a material that is not present within at least one other dowel laminate 702-706. In one embodiment, only one dowel laminate, such as the second dowel laminate 704 comprises a material not present within the remaining dowel laminates 702 and 706. In one such embodiment, the first and the second dowel laminates 702 and 706 may be made of a more rigid material than the second dowel laminate 704.

First dowel laminate 702 is the upper-most dowel laminate and is placed on top of the second dowel laminate 704, which in turn is placed atop the third dowel laminate 706. The dowel laminates 702-706 may be kept in communication with each other through the use of an unbondable adhesive such as represented by the labeled box 750 between dowel laminates 702 and 704, which by its presence and effect between dowel laminates 702 and 704 keeps dowel laminates 702 and 704 in communication with each other. Yet in another embodiment, at least two dowel laminates 702-706 may be held in communication through the assistance of one or more mechanical structures, including but not limited to: rivets, welds, bolts, screws, and/or nails also represented by the exemplary labeled box 750. In certain embodiments, the mechanical structure may be a sheath and/or an exoskeleton that that is formed around at least a portion of an outer surface of the unitary dowel structure 700 that is configured to hold at least two dowel laminates together. In certain embodiments, such a sheath or exoskeleton may be configured to contribute to the flexing properties of the unitary dowel structure 700. In another embodiment, at least one mechanical structure may pass within the perimeter of one or more of the dowel laminates 702-706. Those skilled in the art will appreciate that a wide variety of adhesives and/or mechanical structures, either alone or in combination, may be used to retain communication between the dowel laminates 702-706 and thus maintain the integrity of the unitary dowel structure 700 during flexing when under pressure. Furthermore, the types and quantity of structures (including bonds from adhesives) used to form the unitary dowel structure 700 may vary among different positions and or individual dowel laminates. For example, in one embodiment, such structures are placed to result in a unitary dowel structure 700 that is configured to exhibit less stiffness at edge 708 and/or 714 that at least another portion of the unitary dowel structure 700, such as a portion of the unitary dowel structure that is configured to be placed in vicinity of a joint between two slabs.

As best shown in FIG. 7*a*, the resulting unitary dowel structure 700 has a first edge 708 configured to be inserted into a first slab 710 and extends across a joint 712 and terminates at a second edge 714, which is configured to be inserted into a second slab 716. While edges 708 and 714 are shown to comprise portions of each of first, second and third dowel laminates (702-706), those skilled in the art will appreciate that the illustrated embodiment is merely exemplary and that other embodiments do not require that each dowel laminate within the unitary dowel structure 700 be of the same length, depth, and/or width. In certain embodiments, at least one dowel laminate 702-706 may not extend into at least one slab 710, 716.

As shown in FIG. 7*a*, both slabs 710, 716 curl (extending in an upward vertical direction) away from surface 718. The curling of slabs 710, 716 results in the unitary structure flex. Specifically, as shown in FIG. 7*b*, the unitary dowel structure receives downward forces 720 and 722 (e.g. in the form of stress loads) substantially along the vertical axis in the vicinity of edges 708 and 712, respectively. Those skilled in the art will appreciate that forces 720 and/or 722 may not be exactly parallel to the vertical axis and that other forces along one or more different axis may be received upon the unitary dowel structure 700. The curling of structure 700, however, will result in stress loads that produce downward forces 720 and 722. In response to forces 720 and 722, the unitary dowel structure 700 is configured to flex in a substantially opposite vertical direction, such as arrow 724, which is shown to extend in an upwardly vertical direction.

Returning to FIG. 7*a*, the flexing of the unitary dowel structure (arrow 724) allows the transfer of stress loads from concrete slab 710 (in communication with the first end 708 of the unitary dowel structure 700) and concrete slab 716 (in communication with the second end 714 of the unitary dowel structure 700) without breaking. As used herein, breakage refers to the total separation of a dowel laminate from another dowel laminate, however, excluding weakening or partial separation of at least dowel laminate from another.

While the exemplary unitary dowel structure 700 of FIGS. 7*a* and 7*b* is shown being configured to flex responsive to forces 720 and 722 and bend in the direction of arrow 724, those skilled in the art will readily appreciate that a unitary dowel structure in accordance with certain aspects of this invention may be configured to be flex responsive to warping of curing slabs. For example, warping of slabs 710 and 716 may result in reversal of downward forces 720 and 722 (e.g. in the form of stress loads) substantially along the vertical axis in the vicinity of edges 708 and 712, respectively. For example, forces 720 and/or 722 may comprise upward forces along the vertical axis, and thus a portion of the unitary dowel structure 700 within a joint may flex in a downward direction along the vertical axis. In certain embodiments, a portion of the unitary dowel structure 700 may be constructed to flex in a first direction along a vertical axis (e.g., upward), however, the same portion may not be configured to flex in a second direction (e.g. downward). Yet in another embodiment, a portion of the unitary dowel structure 700 may be configured to flex along both directions along the vertical axis.

In certain embodiments, the unitary dowel structure may be configured to flex up to a predefined angle with respect to the horizontal axis. In another embodiment, the unitary dowel structure is configured to flex to a first position upon receiving a first force and further configured to flex to a second position upon receiving a second force. For example, such a dowel structure may be used for different projects.

As would be appreciated by those skilled in the art, the flexing of the a unitary dowel structure, such as unitary dowel structure 700, along the vertical axis also results in movement along another axis, therefore, certain embodiments may be configured to permit movement of the unitary dowel structure along one or more axes when placed within a concrete slab.

We claim:

1. A laminate/plate dowel system in situ and in use between two concrete slabs comprising:

a first dowel laminate in the form of a first plate having a first end and a second end along a length of a first lateral plane, the first lateral plane being in the form of a side of the first plate, the first laminate further having a width and a vertical depth, the width being substantially greater than the vertical depth;

a second dowel laminate in the form of a second plate having a first end and a second end along a length of a second lateral plane, the second lateral plane being in the form of a side of the second plate, the second laminate further having a width and a vertical depth, the second dowel laminate width being substantially greater than the second dowel laminate vertical depth, wherein the first dowel laminate comprises a first material that is substantially devoid in the second dowel laminate;

wherein at least a portion of the lateral plane of the first dowel laminate is configured to be placed against the lateral plane of the second dowel laminate such that the first and second dowel laminates are stacked vertically when in situ and use between the slabs, wherein upon placing the first dowel laminate against the second dowel laminate, a unitary dowel structure having a first end and a second end along a length of a common lateral plane is formed that is configured to flex in the direction of in situ stacking without breaking to transfer stress loads from a concrete slab in communication with the first end of the unitary dowel structure and a concrete slab in communication with the second end of the unitary dowel structure.

2. The dowel system of claim 1, further comprising a third dowel laminate having a first end and a second end along a length of a lateral plane, the third laminate further having a width and a vertical depth.

3. The dowel system of claim 1, wherein the unitary dowel system is configured to flex up to about a first position from the lateral plane in a vertical direction.

4. The dowel system of claim 1, wherein the unitary dowel system is configured to flex at about a first position from the lateral plane in a vertical direction upon being subjected to a first force and further configured to flex to about a second position upon being subjected to a second force.

5. The dowel system of claim 1, wherein the first end of at least one of the first dowel laminate and the second dowel laminate has a width that is smaller than the width of the second end of at least one of the first dowel laminate and the second dowel laminate.

6. The dowel system of claim 1, wherein at least one dowel laminate comprises a trapezoidal shape when viewed along the lateral plane.

7. The dowel system of claim 1, wherein the communication of at least two of the dowel laminates comprises an unbondable adhesive.

8. The dowel system of claim 1, wherein the communication of at least two of the dowel laminates comprises a mechanical structure.

9. The dowel system of claim 8, wherein the mechanical structure comprises a structure that is formed around at least a portion of an outer surface of the unitary dowel laminate.

10. The dowel system of claim 8, wherein the mechanical structure comprises structure that passes within a perimeter of an outer surface of at least one of the first or the second dowel laminates.

11. A laminate/plate dowel system method comprising:

providing a first dowel laminate in the form of a first plate having a first end and a second end along a length of a first lateral plane, the first lateral plane being in the form of a side of the first plate, the first laminate further having a width and a vertical depth, the width being substantially greater than the vertical depth;

joining a second dowel laminate to the first dowel laminate, wherein the second dowel laminate is in the form of a second plate and comprises a first end and a second end along a length of a second lateral plane, the second lateral plane being in the form of a side of the second plate, the second laminate further having a width and a vertical depth, the second dowel laminate width being substantially greater than the second dowel laminate vertical depth, and wherein the first laminate comprises a first material that is substantially devoid in the second laminate;

wherein at least a portion of the lateral plane of the first dowel laminate is configured to be placed against the lateral plane of the second dowel laminate such that the first and second dowel laminates are stacked vertically, wherein upon placing the first dowel laminate against the second dowel laminate, a unitary dowel structure having a first end and a second end along a length of a common lateral plane is formed that is configured to flex in the direction of stacking without breaking to transfer stress loads from a concrete slab in communication with the first end of the unitary dowel structure and a concrete slab in communication with the second end of the unitary dowel structure; and placing the unitary dowel structure with the concrete slabs such that the unitary dowel structure is placed to flex in the direction of in situ stacking without breaking to transfer stress loads from the slabs.

* * * * *